US011971236B1

(12) United States Patent
James

(10) Patent No.: US 11,971,236 B1
(45) Date of Patent: Apr. 30, 2024

(54) HINGE-MOUNTED BRACKET FOR SUPPORTING GUN HOLDER

(71) Applicant: Manufacturing Made Simple LLC, Norman, OK (US)

(72) Inventor: Jerry A. James, Norman, OK (US)

(73) Assignee: Manufacturing Made Simple LLC, Norman, OK (US)

( * ) Notice: Subject to any disclaimer, the term of this patent is extended or adjusted under 35 U.S.C. 154(b) by 0 days.

(21) Appl. No.: 17/929,693

(22) Filed: Sep. 3, 2022

Related U.S. Application Data

(60) Provisional application No. 63/244,606, filed on Sep. 15, 2021.

(51) Int. Cl.
*F41A 23/00* (2006.01)
*A47B 81/00* (2006.01)
*F41A 23/18* (2006.01)

(52) U.S. Cl.
CPC ..... *F41A 23/18* (2013.01); *A47B 81/005* (2013.01); *F41A 23/00* (2013.01)

(58) Field of Classification Search
CPC ..... F41A 23/18; F41A 23/52; F41A 17/10; F41A 17/12; F41A 23/00; A47B 81/005; A47B 81/00; A47G 25/0621; Y10T 16/522
USPC ..... 248/213.1
See application file for complete search history.

(56) References Cited

U.S. PATENT DOCUMENTS 914,697 A 3/1909 Bryant
1,208,986 A * 12/1916 Krodel ..... F16M 13/02 235/114
2,054,371 A 9/1936 Biltz
2,176,723 A 10/1939 Sauer
2,270,802 A 1/1942 Kristensen
2,487,652 A 11/1949 Heinrich
2,539,803 A 1/1951 Westberg
2,595,521 A * 5/1952 Hanson ..... D06F 57/12 248/213.1
2,684,225 A 7/1954 Johnson
2,895,698 A * 7/1959 Palmer ..... A47G 25/08 248/213.1
2,896,791 A * 7/1959 Raber ..... A47G 25/0621 248/213.1
3,043,523 A * 7/1962 Hogstrom ..... B65D 83/267 248/213.1
3,044,630 A * 7/1962 Szabo ..... A47G 25/0621 248/213.1

(Continued)

*Primary Examiner* — Nkeisha Smith
(74) *Attorney, Agent, or Firm* — Mary M. Lee

(57) ABSTRACT

A bracket mountable on a door hinge for supporting a gun holder behind an open door. The bracket includes a docking station and an adapter. The docking station mounts to the hinge. The adapter attaches to any gun holder, such as a holster. The gun is stowed in the gun holder on the docking station until needed. When needed, the gun is withdrawn from the mounted holster. Or, the holstered gun with the adapter attached can be lifted out of the docking station to carry or relocate it. Alternately, the gun holder may be a magnet with or without a magnetically transparent holster. The magnet stays attached to the adapter, which is left in the docking station. The gun—holstered or unholstered—adheres magnetically to the bracketed magnet. When needed, the gun is pulled off the magnet and returned to a carry position.

28 Claims, 11 Drawing Sheets

(56) References Cited

U.S. PATENT DOCUMENTS

| | | | | | |
|---|---|---|---|---|---|
| 3,175,696 | A | | 3/1965 | Milbourne | |
| 3,291,317 | A | * | 12/1966 | Bowen | F41A 23/18 248/220.21 |
| 3,825,127 | A | * | 7/1974 | Morrison | E05D 11/00 248/289.11 |
| 4,930,738 | A | * | 6/1990 | Lombardo | E05F 15/70 248/220.21 |
| 5,117,987 | A | | 6/1992 | Lombardo | |
| 5,425,462 | A | | 6/1995 | Sciranka | |
| 5,505,317 | A | | 4/1996 | Rulis et al. | |
| 6,050,427 | A | * | 4/2000 | Loveland | E05D 11/00 211/119.004 |
| 6,193,084 | B1 | | 2/2001 | Oliver | |
| 6,658,696 | B2 | * | 12/2003 | Buckelew | E05D 11/00 16/86 B |
| 6,722,511 | B1 | | 4/2004 | Lowe | |
| 7,908,711 | B2 | * | 3/2011 | Johnson | A47G 25/06 16/369 |
| 8,113,608 | B2 | | 2/2012 | Tassin et al. | |
| 8,209,896 | B1 | * | 7/2012 | Cashwell | F41C 27/00 269/47 |
| 8,777,339 | B2 | | 7/2014 | Tassin et al. | |
| D717,701 | S | | 11/2014 | Hudson et al. | |
| 9,261,326 | B1 | * | 2/2016 | Chandler | F41A 23/18 |
| 9,295,347 | B2 | | 3/2016 | Mackay | |
| 9,463,903 | B2 | * | 10/2016 | Garrett, Sr. | B65D 25/22 |
| 9,609,947 | B1 | | 4/2017 | Tassin et al. | |
| 10,415,744 | B1 | | 9/2019 | Atalla et al. | |
| 10,465,843 | B2 | * | 11/2019 | Mantella | H01F 7/0252 |
| 10,946,233 | B1 | * | 3/2021 | Neeley, Jr. | A63B 21/1663 |
| 11,619,464 | B2 | * | 4/2023 | Cerda | B60R 7/14 248/205.3 |
| 2019/0352951 | A1 | * | 11/2019 | Howson | E05D 5/128 |

* cited by examiner

HINGE-MOUNTED BRACKET FOR SUPPORTING GUN HOLDER

CROSS-REFERENCE TO RELATED APPLICATIONS

This application claims the benefit of U.S. provisional application No. 63/244,606 entitled "Hinge-Mounted Bracket for Supporting Gun Holder," filed Sep. 15, 2021, the contents of which are incorporated herein by reference.

FIELD OF THE INVENTION

The present invention relates to firearms generally and, more particularly but without limitation, to devices for mounting firearms.

BRIEF DESCRIPTION OF THE DRAWINGS

The accompanying drawings, which are incorporated into and form a part of the specification, illustrate one or more embodiments of the present invention and, together with this description, explain the principles of the invention. The drawings merely illustrate a preferred embodiment of the invention and are not to be construed as limiting the scope of the invention.

DETAILED DESCRIPTION OF THE PREFERRED EMBODIMENT(S)

Figure 1:
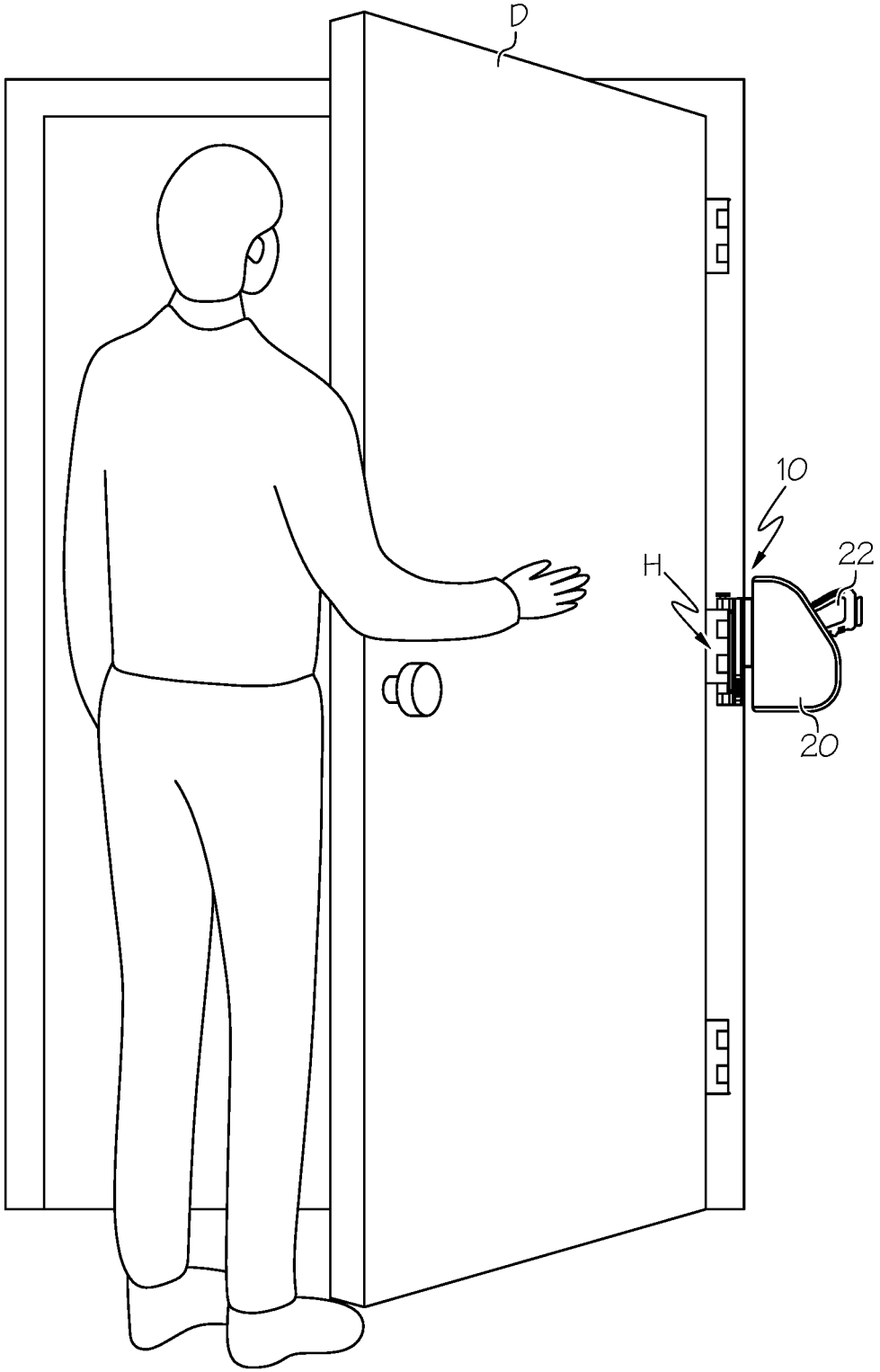
FIG. 1 illustrates the use of the present invention by showing a man standing in an open doorway as if to greet a visitor with his right hand reaching behind the door for the pistol in the hinge-mounted holster.

Most individuals who choose to own personal firearms do so to protect their families, their homes, and businesses. When the firearm is not being worn on one's person, it may be important to have ready access to it. For example, a handgun may be kept in a drawer or cabinet in one's home or office. While these locations may be suitable in some cases, it may also be desirable to have the gun within arm's reach at a doorway, such as the home's entry door, a bedroom door, or the entrance to a business or office. This behind-the-door location allows one confronting a threatening person at the doorway to grab the gun without the action being obvious to the visitor.

The present invention provides a bracket for supporting a gun holder, such as a holster, on one of the hinges of a door. In this way, the bracket and gun are concealed when the door is open and visible only to those inside the room when the door is closed. Yet, the gun is supported at chest height and readily accessible.

The bracket is easily installed in mere minutes on any common hinge without the use of any special tools, except as may be required to remove the hinge pin. Additionally, modification of the door or hinge is unnecessary. Most homes have standard 3.5-inch hinges on interior doors and 4.0-inch hinges on exterior doors. The inventive bracket includes a replacement hinge pin or bracket pin with a spacer ring so that the hinge pin can be fitted to either a 4-inch hinge without the spacer ring or a 3.5-inch pin with the spacer ring.

The bracket can be used with any type of gun holder, including without limitation, a flexible or rigid holster, a case or other enclosure, a vault, a safe, an individual hand gun rack, a lock box, or simply a magnet, as explained hereafter. The bracket will support either a generic holster or a brand-specific model.

Because the bracket can support almost any gun holder, the bracket can be used for any type of firearm. Even a long gun, such as a shotgun or rifle, can be mounted easily using a pair of brackets—one in each of two hinges on the door. As used herein, "gun" and "firearm" are used synonymously and denote a small arms weapon from which a projectile is fired by gunpowder and designed to be carried and used by an individual. These terms include handguns, such as pistols and revolvers, and long guns, including rifles and shotguns.

Because the bracket fits on any standard hinge, it can be mounted on any door, whether in a home or business, and whether an interior or exterior door. Moreover, because the bracket is relatively inexpensive and unobtrusive, one can install multiple brackets in different locations. The bracket comprises two main components—a docking station that engages the door hinge and an adapter that releasably engages the docking station. In some embodiments, the adapter remains attached to the selected gun holder.

The gun and attached adapter can be retrieved from one docking station and then placed in the docking station of another bracket in a different room or building. For example, the gun may be stowed at the front door during the day and relocated to the bedroom door at night. Still further, the gun may be stowed at the workplace during the day and then kept at any desired location at the home overnight and on weekends.

For example, in the case of a holster, the gun simply can be withdrawn from the holster and used, when needed. Or the holster and gun, if desired, with the attached adapter may be released from the docking station and either carried or relocated. In the case of a "magnet-only" embodiment, a magnet is attached to the adapter. A metal gun sheathed in a fabric or other magnetically transparent material, will adhere to the mounted magnet. Again, if desired, in this "sticky holster" embodiment, the adapter and attached magnet also can be relocated as desired.

The present invention contemplates an assembly comprising a single docketing station and adapter, or multiple docking stations and one adapter. The assembly may include one or more gun holders, such as a generic holster. Still further, the inventive bracket, with or without the gun holder, may be sold with a suitable firearm.

These and other features and advantages of the present invention will become apparent from the following description with reference to the accompanying drawings.

Turning now to the drawings in general and to FIG. 1 in particular, there is shown therein a hinge-mounted bracket for supporting a firearm constructed in accordance with one embodiment of the present invention and designated generally by the reference numeral 10. As illustrated in FIG. 1, the bracket 10 is designed to be mounted to one of the hinges H of a door D. As shown in FIG. 1, the bracket 10 is shown mounted to the middle of three hinges H. However, this may vary depending on several factors, such as the number of hinges, the size of the firearm, and the height of the user.

Referring now also to FIGS. 2-6, the bracket 10 comprises a docking station 12 and an adapter 14. The docking station 12 mounts to the hinge H, and the adapter 14 attaches to a gun holder, such as the holster 20. The gun holder 20 may vary, but should be selected to securely support the firearm, such as the pistol 22 (FIGS. 1 and 2), with which it is to be used.

In most instances, the adapter 14 will remain attached to the holster 20 even when the holster and pistol 22 are not "docked." Importantly, the use and function of a gun holster is not affected by the attached adapter. For example, those who carry handguns on their person often use a holster with a clip that supports the holster on a belt or waist band (inside or outside the waistband). Attachment of the adapter 14 to the holster 20 does not interfere with its customary use.

Figure 2:
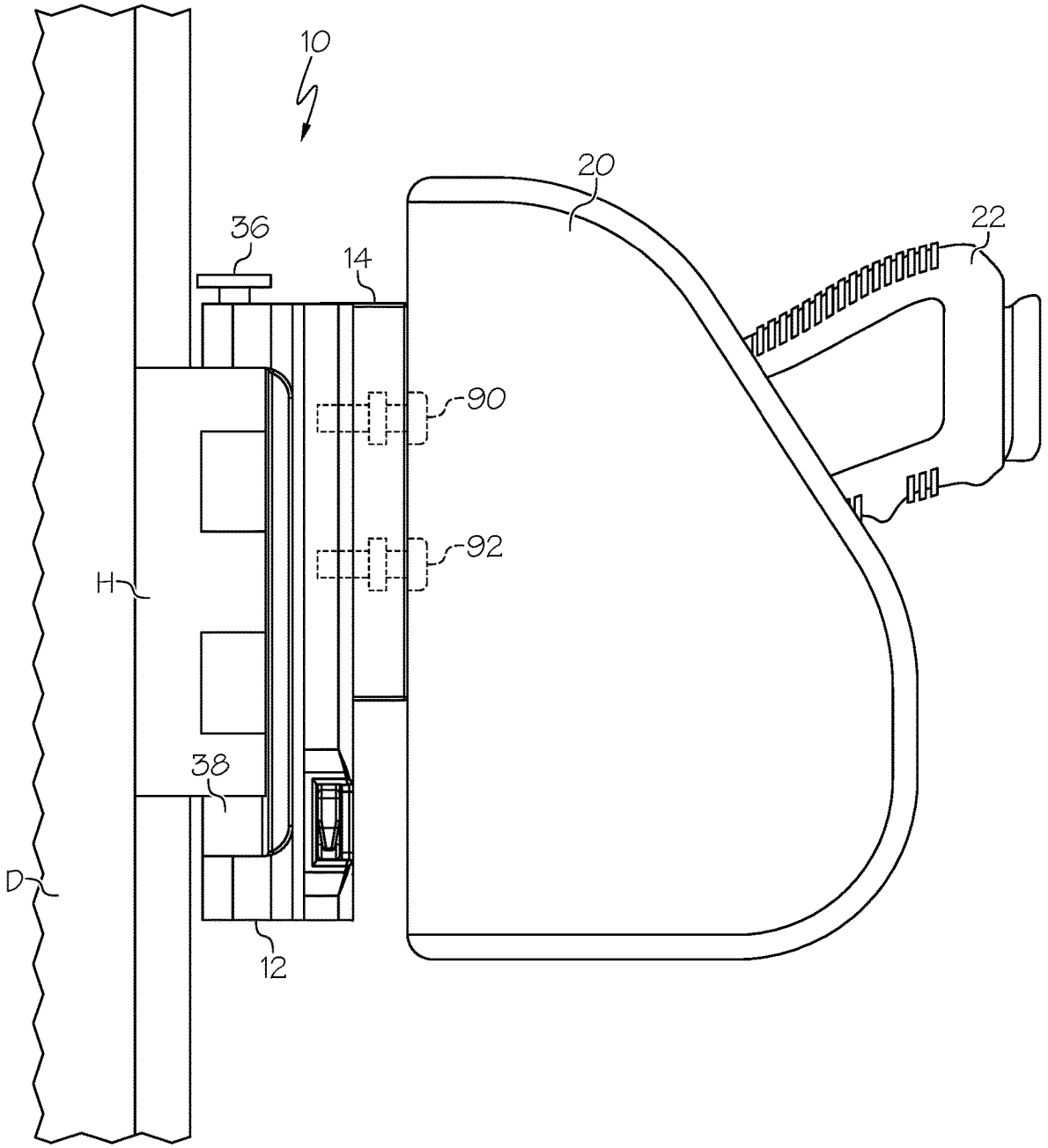
FIG. 2 is an enlarged perspective view of the mounted holster and pistol.

Turning now to FIGS. 7-11, one embodiment of the docking station 12 will be described. The docking station 12 includes an elongate docking body 30. At least one and preferably two hinge loops extend rearwardly from the body. In the embodiment shown, the hinge loops include an upper hinge loop 32 and a lower hinge loop 34. As will be explained more fully below, each of the hinge loops 32 and 34 is sized to fit with the knuckles of the door hinge H (FIG. 2).

A bracket pin 36 may be included to replace the original hinge pin (not shown) of the door hinge H. In the embodiment shown, the bracket pin 36 is sized for a 4-inch door hinge. That is, the length of the bracket pin 36 may be long enough to extend through the knuckles of the door hinge H plus the upper and lower hinge loops 32 and 34 so as to securely attach the docking station 12 to the hinge H.

As discussed previously, it is desirable for the bracket 10 to be usable alternately with either a standard 3.5-inch door hinge (shown) or a standard 4.0-inch door hinge. To that end, the bracket pin 36 and wherein the docking station further comprises a spacer ring configured to receive the bracket pin 36 may have a length selected to fit a standard 4.0-inch hinge.

The docking station 12 may also include a spacer ring 38 to adapt it for use with the smaller 3.5-inch hinge. The spacer ring 38 may be a simple tubular member having an inner diameter sized to receive the bracket pin 36 and an outer diameter sized to conform to the hinge loops 32 and 34. The length of the spacer ring 38 is selected to fit between the upper or lower knuckle of the door hinge and the upper or lower hinge loop 32 and 34, respectively, when the docking station 12 is installed on a 3.5-inch door hinge. As shown herein, the spacer ring 38 is positioned between the bottom of the hinge H and the lower hinge loop 34.

A indicated, the adapter 14 is releasably engageable with the docking station 12, that is, the adapter 14 can be engaged and disengaged manually without the use of any tool. In the embodiment illustrated, the engagement takes the form of a sliding engagement that includes a detent for releasably securing the adapter to the docking body 30, as set out below. For that purpose, the docking body 30 may include a docking recess. As used herein, "detent" means a mechanism (such as a catch, dog, or spring-operated ball) that temporarily keeps one part in a certain position relative to that of another and can be released by applying force to one of the parts.

The docking recess may be an elongate vertical C-shaped channel 42 comprising a planar back surface 44 flanked by forwardly extending side flanges 46 and 48. The bottom end of each of the side flanges 46 and 48 may form a rigid tab, such as the shoulders 52 and 54, which will form part of the detent mechanism described below.

With continuing reference to FIGS. 2-6, and referring now also to FIGS. 12-17, one embodiment of the adapter 14 will explained. The adapter 14 may include an elongate adapter body 60. The adapter 14 may also include a docking section 62 that is releasably engageable with the docking recess 42 of the docking station 12. In order to cooperate with the channel 42 on the docking station 12, the docking section 62 of the adapter body 60 includes vertical rails 64 and 66 configured to slide inside the flanges 46 and 48 of the channel 42.

The adapter 14 may also include a cooperating structure to form, with the shoulders 52 and 54 of the flanges 46 and 48, a complete detent mechanism. To that end, the adapter body 60 may include at least one flexible prong. In this embodiment, first and second prongs 70 and 72 extend downwardly from the bottom ends of the rails 64 and 66. Each of the prongs 70 and 72 comprises a stop 74 and 76 with tapered leading ends 78 and 80, respectively.

Figure 3:
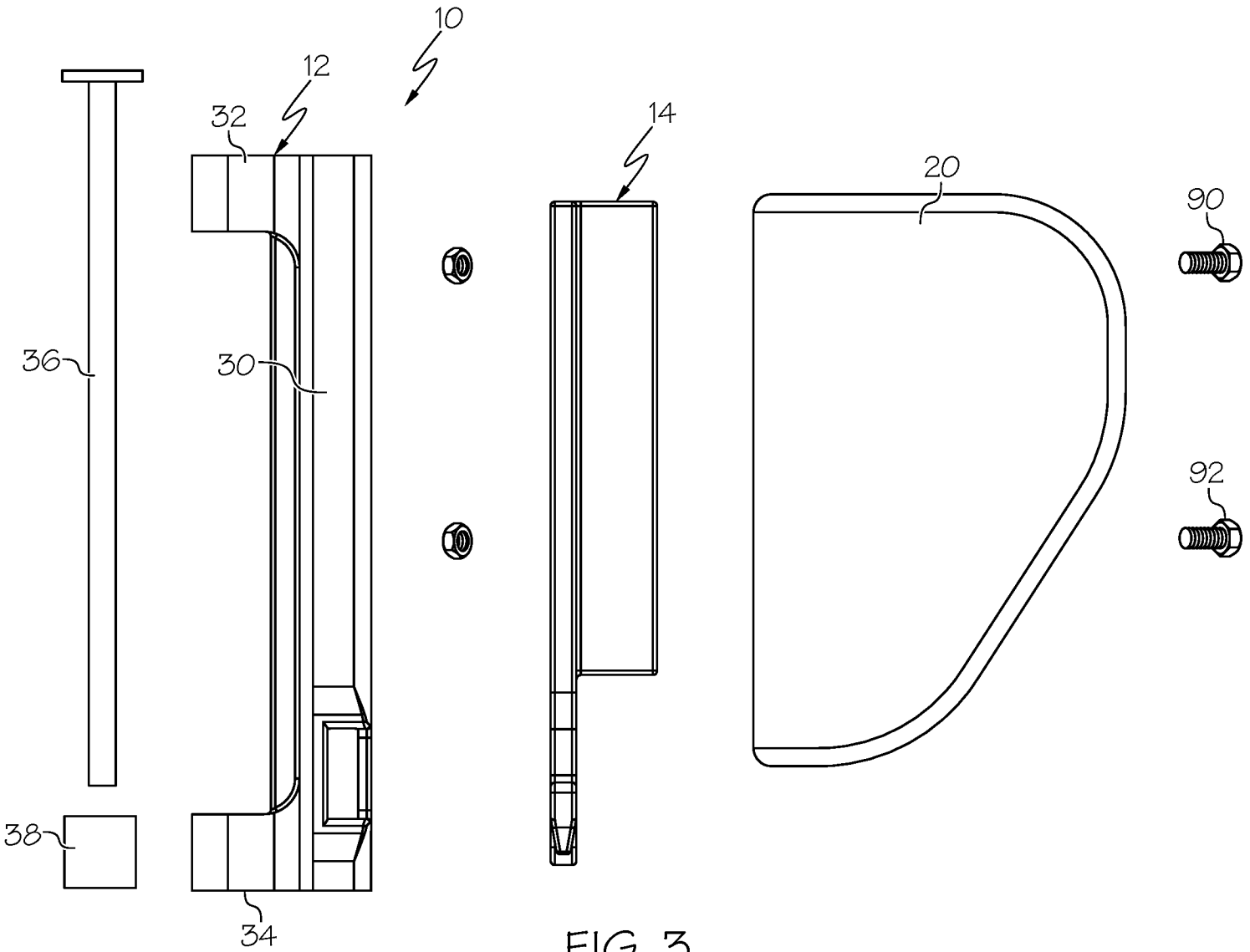
FIG. 3 is an exploded view of the gun bracket and holster.

To enable the attachment of the adapter 14 to the gun holder, the adapter includes an attachment section 82. The type of attachment may vary. In the embodiment shown and described herein, the adapter is simply bolted to the gun holder. The attachment section 80 comprises a vertical, planar surface 84 spaced a distance forward of the rails 64 and 66 and defining one or more bolt holes 86 and 88 that are spaced apart vertically. Ideally, the bolt holes are elongate, vertically oriented slots. The adapter 14 may also include properly sized nuts and bolts, designated generally by the reference numbers 90 and 92 (FIG. 3).

Figure 4:
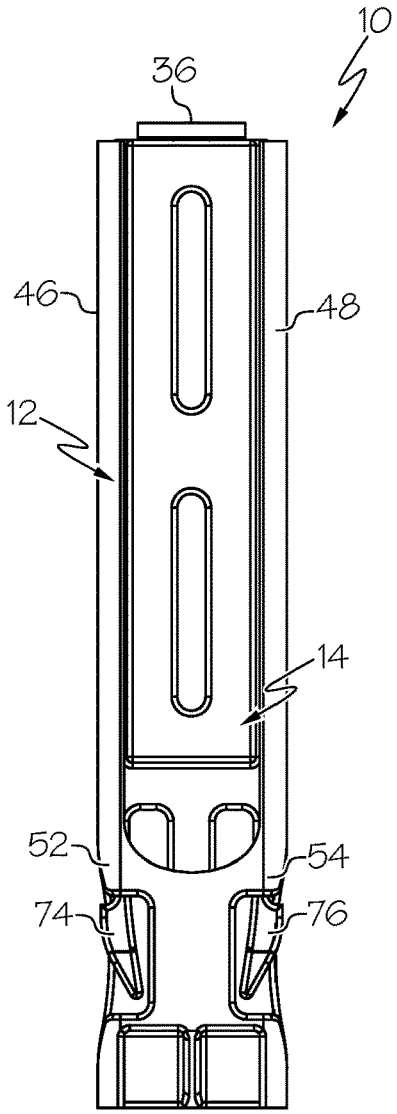
FIG. 4 is a front elevational view of the bracket comprising the assembled docking station and adapter clip.
Figure 5:
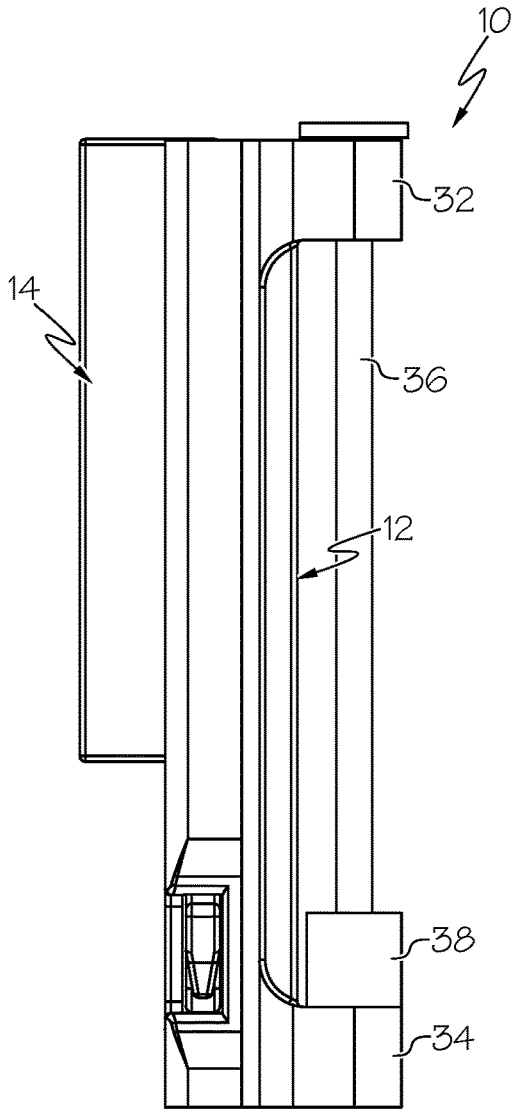
FIG. 5 is a side elevational view of the assembled docking station and adapter clip.
Figure 6:
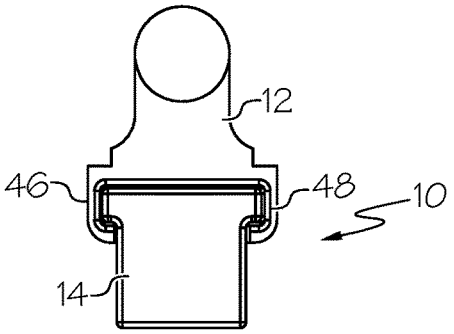
FIG. 6 is a plan view of the assembled docking station and adapter clip.
Figure 7:
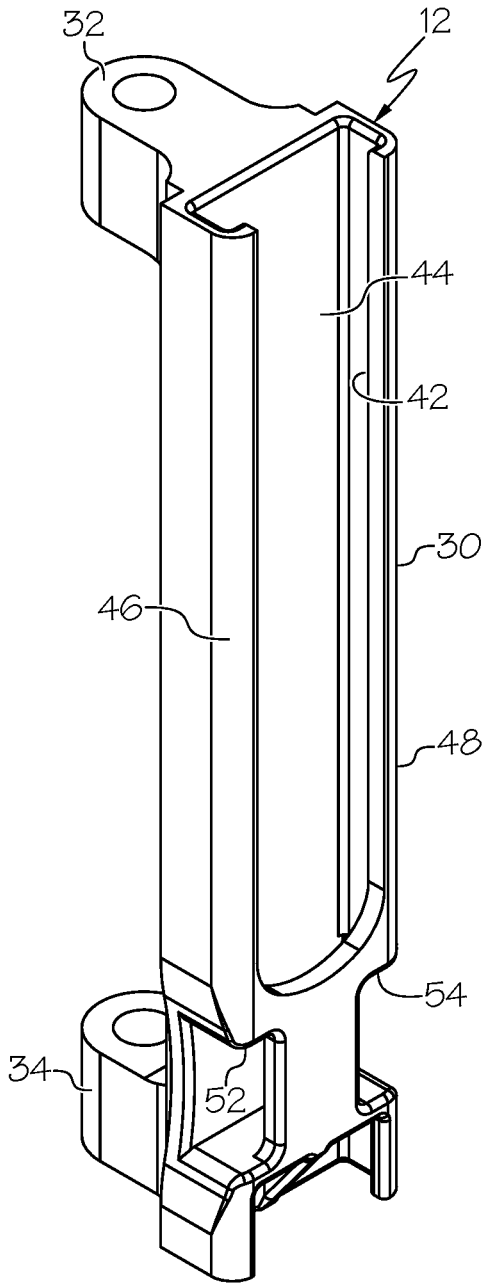
FIG. 7 is a front perspective view of the docking station.
Figure 8:
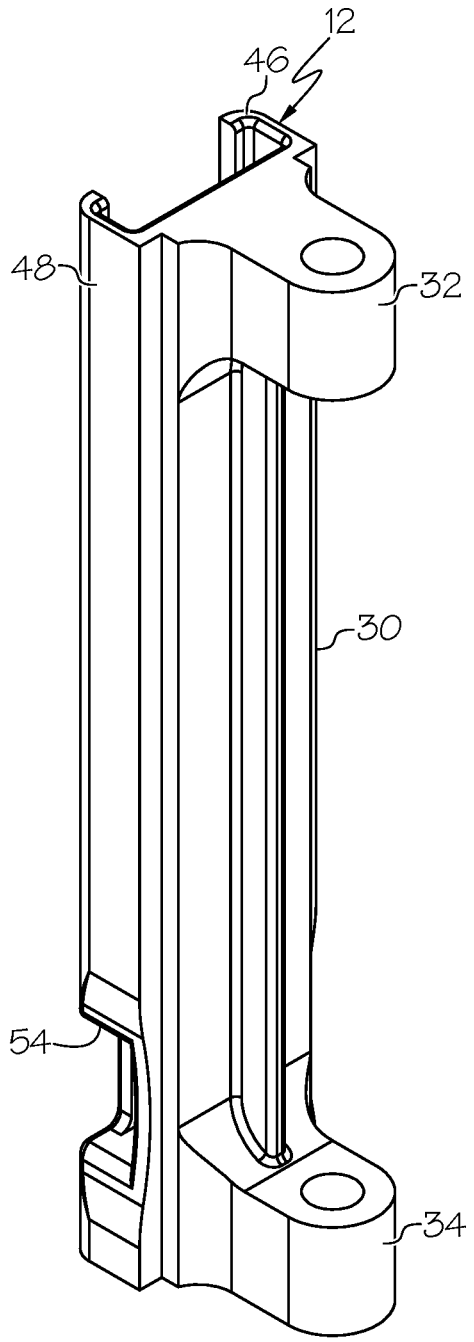
FIG. 8 is a rear perspective view of the docking station.
Figure 9:
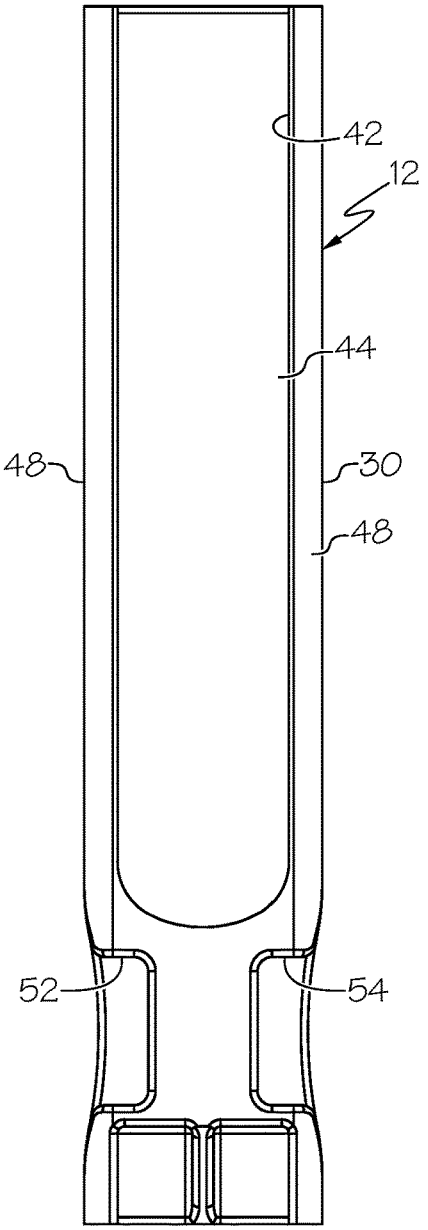
FIG. 9 is a front elevational view of the docking station.
Figure 10:
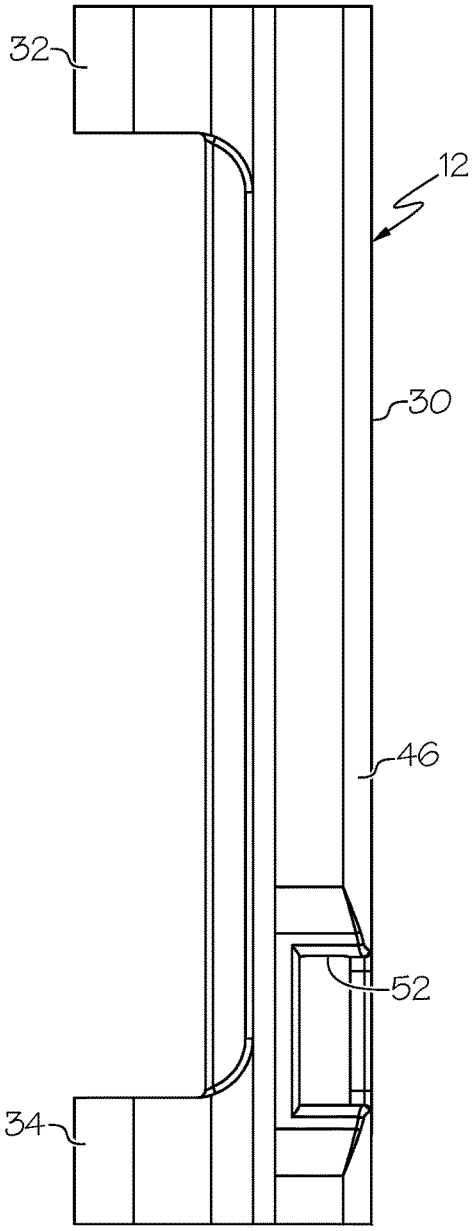
FIG. 10 is a side elevational view of the docking station.
Figure 11:
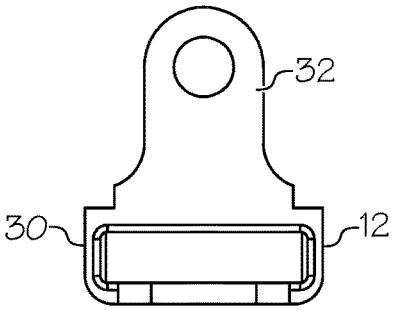
FIG. 11 is a plan view of the docking station.
Figure 12:
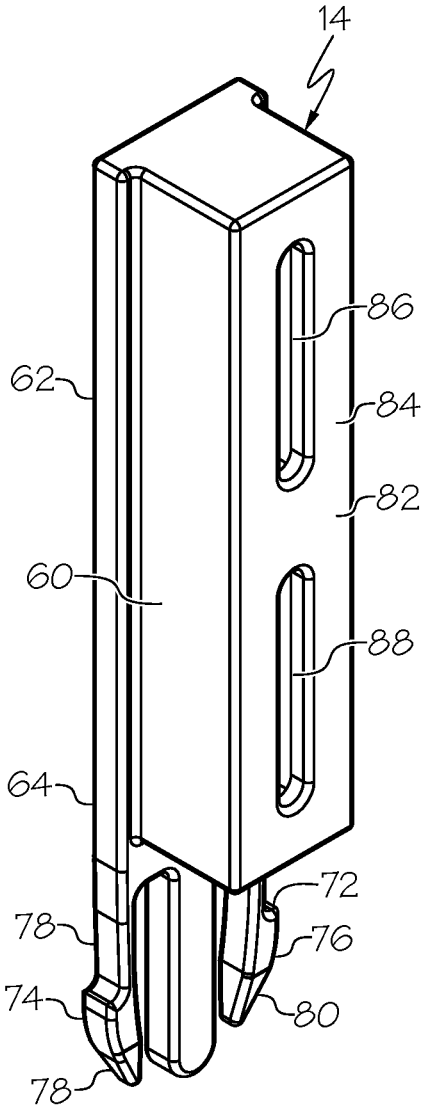
FIG. 12 is a front perspective view of the adapter clip.
Figure 13:
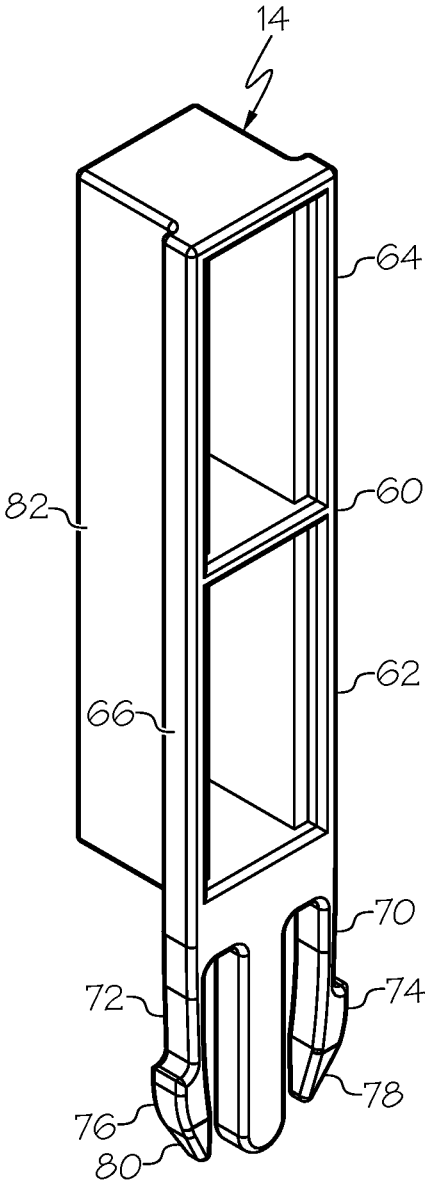
FIG. 13 is a rear perspective view of the adapter clip.
Figure 14:
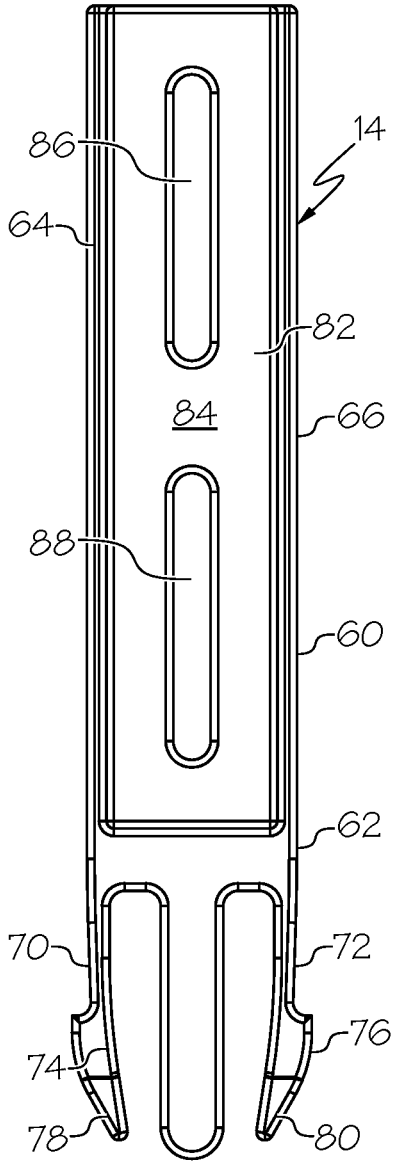
FIG. 14 is a front elevational view of the adapter clip.
Figure 15:
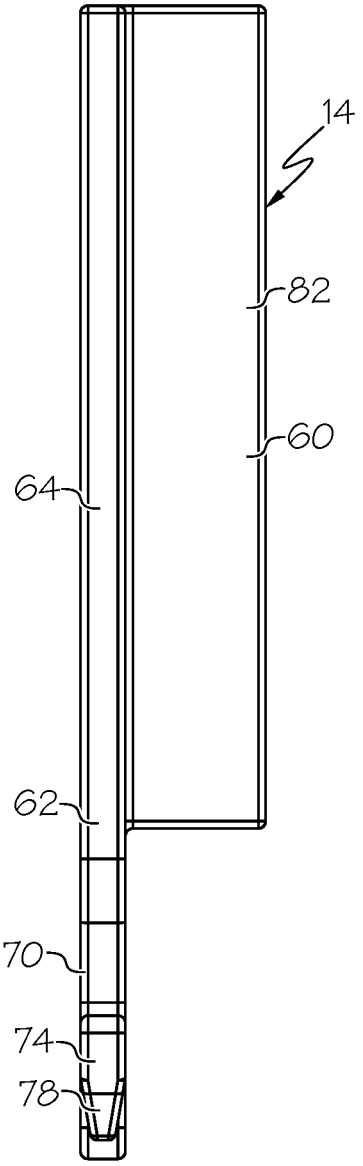
FIG. 15 is a side elevational view of the adapter clip.
Figure 16:
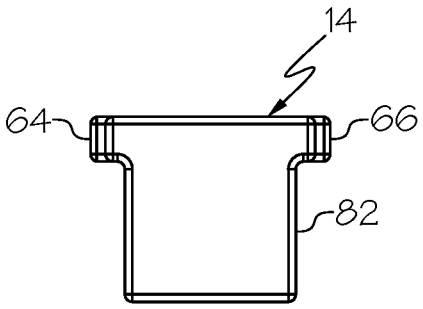
FIG. 16 is a plan view of the adapter clip.
Figure 17:
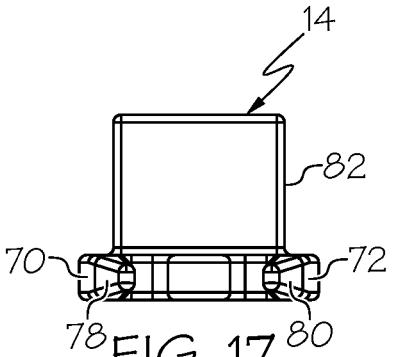
FIG. 17 is a bottom view of the adapter clip.
Figure 18:
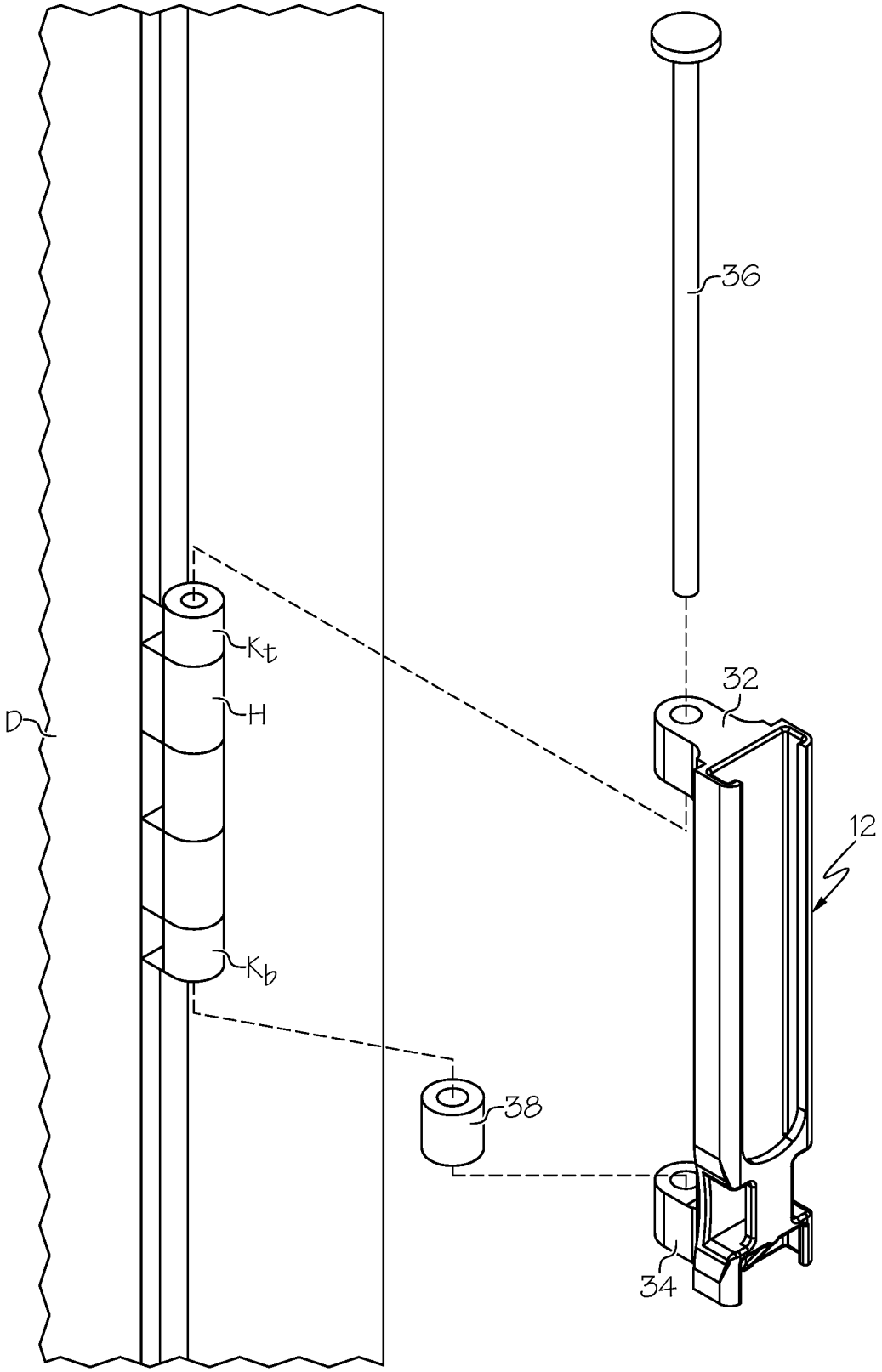
FIG. 18 is an exploded, perspective view of an assembly comprising the inventive bracket and the door hinge to which it is mounted.
Figure 19:
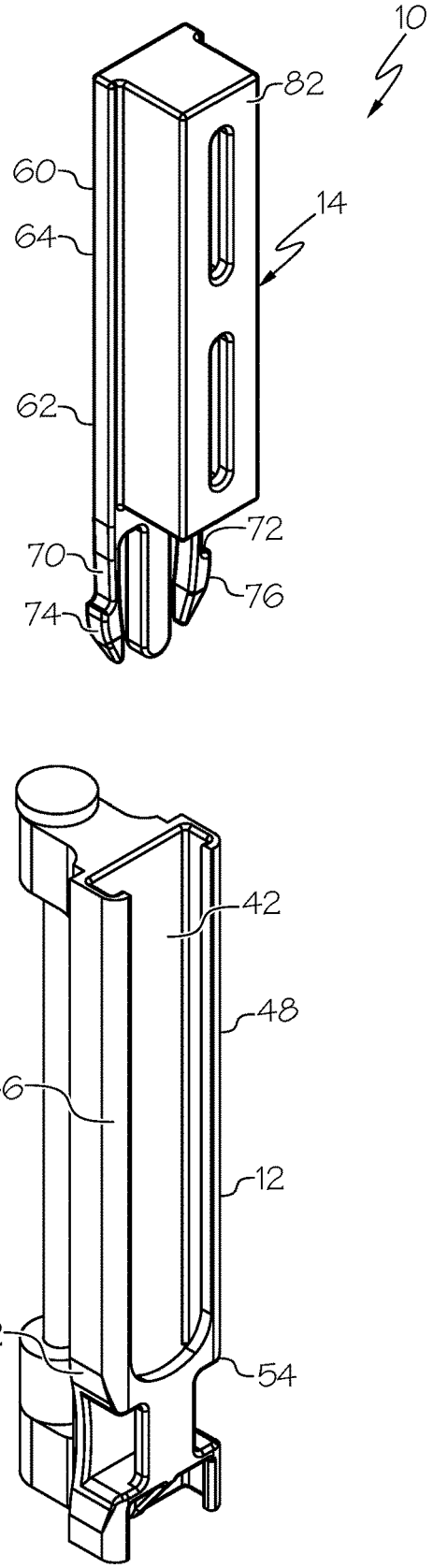
FIG. 19 is an exploded view of the bracket comprising the docking station with bracket pin and adapter clip.

FIG. 19 illustrates the sliding engagement of the docking station 12 and the adapter 14. Now it will be apparent the outer dimension of the stops 74 and 76 of the prongs 70 and 72 is wider than the inner dimension between the flanges 46 and 48 of the docking recess 42. By way of example, as seen in FIG. 4, the outer dimension of the stops 74 and 76 may be about the same as the outer dimension of the flanges 46 and 48.

Because the prongs 70 and 72 are flexible, they will yield as they are pressed into the top of the channel 42. Then, when the stops 74 and 76 pass the bottom of the flanges 46 and 48, the stops will re-expand. In this position, the stops 74 and 76 abut the shoulders 52 and 54 under the ends of the flanges 46 and 48. In this way, the adapter 14 cannot be withdrawn or lifted from the docking station until pressure is applied to the stops 74 and 76 by squeezing them together. Thus, the prongs 70 and 72 and stops 74 and 76 cooperatively configured to form the detent mechanism.

Having described the structure of the illustrated embodiment, its use now will be explained. First, the docking station is mounted on the door hinge. The original hinge pin is removed in the conventional manner. Next, the docking station is positioned on the hinge with the upper hinge loop 32 above the top knuckle Kt and the lower hinge loop 34 below the bottom knuckle Kb. Here, the hinge H is a 3.5-inch hinge, so the spacer ring 38 is positioned between the bottom knuckle Kb and the lower hinge loop 34. Then, the bracket pin 36 is inserted through the pin bore formed through the hinge knuckles, the spacer pin 36 and hinge loops 32 and 34.

Figure 20:
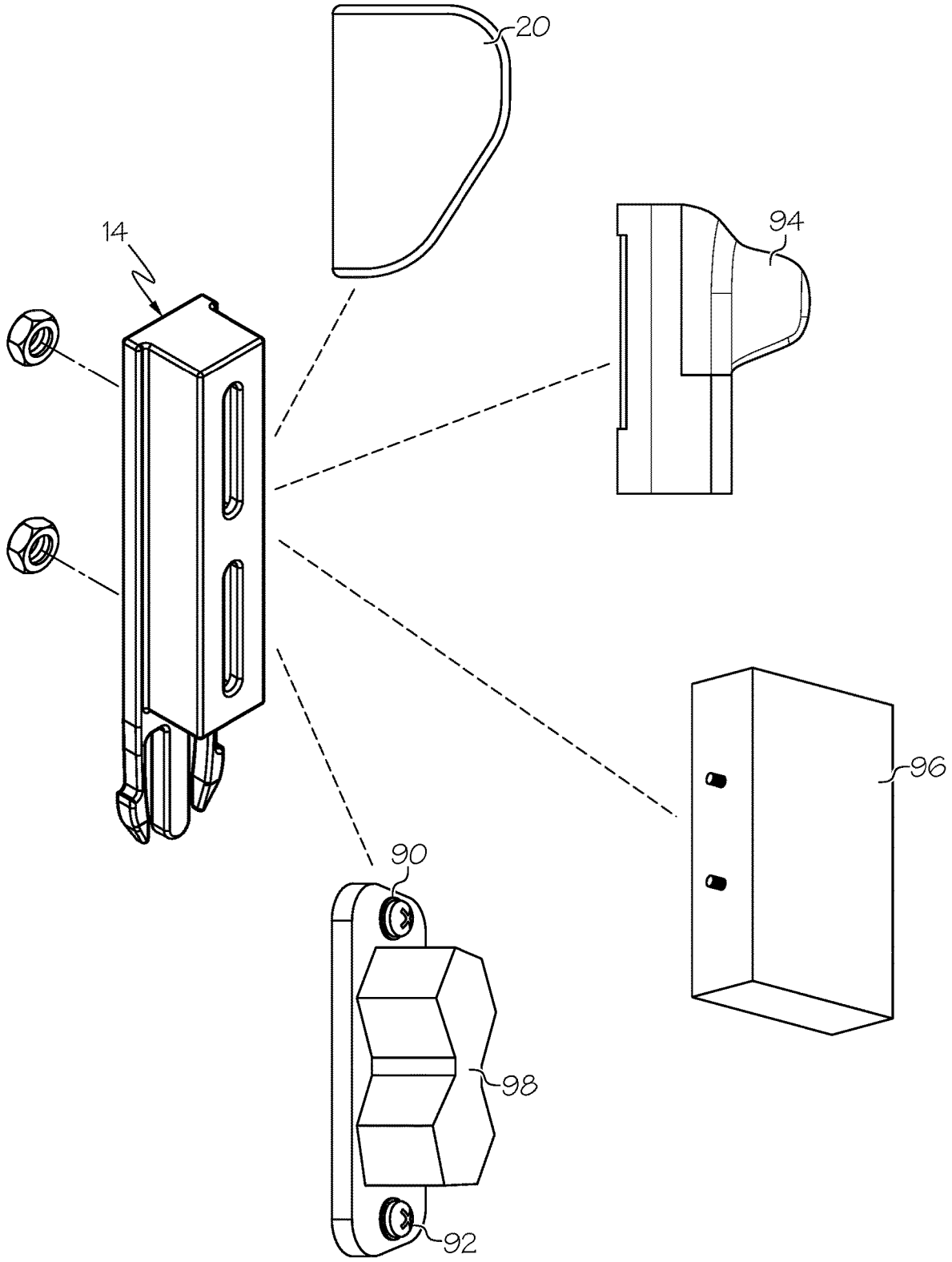
FIG. 20 is an illustration of how the inventive bracket can be used alternately with different types of gun holders.

Turning to FIGS. 3 and 20, the desired gun holder, such as the flexible holster 20, is selected and attached to the adapter 14 using the bolts 90 and 92. Now it will be appreciated that the attachment section 82 of the adapter 14 may be configured so that the ends of the bolts will be enclosed. As shown in FIG. 20, the same adapter 14 can be attached to virtually any type of gun holder, which includes without limitation, the flexible holster 20, as seen in the other figures, as well as a rigid holster 94, the lock gun enclosure 96, and magnet 98. The box-shaped enclosure 96 shown in FIG. 20 is intended to represent any type of gun enclosure. As used herein, "gun enclosure" means any type of full enclosure, including a gun safe, a gun lock box, a gun case, or a gun vault, for preventing unauthorized access to the firearm and which is not designed for holstering the firearm when it is being carried.

As mentioned above, when a magnet 98 is attached to the adapter and the pistol 22 is stowed in a fabric or other magnetically transparent material, the adapter/magnet may be left in the docking station 12; the pistol will adhere to the magnet through the holster. Still further, an unholstered pistol will adhere to the magnet 98 so that the magnet alone serves as the gun holder.

Although not illustrated in the drawings, it will be apparent that for long guns, a pair of inventive brackets may be used. In this embodiment, the gun holder on one bracket would be used to hold the barrel of the gun, and the gun holder on the other bracket would be configured to hold the stock or grip. Thus, the configuration of the two gun holders may be different.

For the purpose of this description, the words left, right, front, rear, top, bottom, inside, outside, upper, lower, vertical, and horizontal, may be used to describe the various parts and directions of the invention as depicted. These descriptive terms should not be considered as limiting the possible orientations of the invention or how it may be used. The terms are merely used to describe the various parts and directions so they may be readily understood and located in the drawings.

The embodiments shown and described above are exemplary. Many details are often found in the art and, therefore, many such details are neither shown nor described herein. It is not claimed that all the details, parts, elements, or steps described and shown herein are newly invented. Changes may be made in the details, especially in matters of shape, size, and arrangement of the parts, within the principles of the invention to the full extent indicated by the broad meaning of the terms in the attached claims. The description and drawings of the specific embodiments herein do not point out what an infringement of this patent would be, but rather provide non-limiting examples of how to use and make the invention. Likewise, the abstract is neither intended to define the invention, which is measured by the claims, nor is it intended to be limiting as to the scope of the invention in any way. The limits of the invention and the bounds of the patent protection are measured by and defined in the following claims.

What is claimed is:

1. A bracket for supporting a gun holder on a door hinge, the door hinge comprising a plurality of knuckles, each knuckle having a pin passage, wherein when the knuckles are aligned, the pin passages therethrough collectively form a pin bore for receiving a hinge pin, the bracket comprising:
- a docking station comprising:
  - a docking body;
  - at least one hinge loop extending from the body, the loop sized to fit with the knuckles of the door hinge so that the loop is alignable with the pin bore; and
  - a docking recess on the docking body;
- an adapter comprising:
  - an adapter body;
  - a docking section configured for manual tool-free engagement and disengagement with the docking recess of the docking station; and
  - an attachment section configured for attachment to the gun holder; and
- a detent configured to releasably secure the docking section of the adapter in the docking recess of the docking station.

2. The bracket of claim 1 wherein the at least one hinge loop includes an upper and lower hinge loop, and wherein the bracket further comprises a bracket pin configured to extend through the door hinge knuckles and the upper and lower door hinge loops when the hinge loops are aligned with the door hinge knuckles.

3. The bracket of claim 2 wherein the distance between the upper and lower hinge loops on the docking body is selected to receive a 4.0-inch door hinge and wherein the bracket further comprises a spacer ring configured to receive the bracket pin therethrough and having a length selected to fit on the bracket pin between an end of the door hinge and one of the upper and lower hinge loops on the docking station when the docking station is installed on a 3.5-inch door hinge.

4. The bracket of claim 1 wherein the docking section on the adapter body is slidably engageable with the docking recess.

5. The bracket of claim 4 wherein the docking recess is a vertical channel and the docking section of the adapter comprises vertical rails.

6. The bracket of claim 5 wherein the detent comprises at least one flexible prong on one of the adapter body and the docking body and at least one rigid shoulder on the other of the adapter body and the docking body, the at least one prong movable between an extended position at rest and a compressed position in response to pressure, wherein each of the at least one prong comprises a stop, and wherein the at least one prong and the at least one shoulder are cooperatively configured so that as the rails of the adapter slide into the channel of the docking station the at least one prong yields to move past the at least one shoulder and then returns to the extended position when the stop passes the at least one shoulder and so that the stop prevents the adapter from being withdrawn from the docking recess unless pressure is applied to recompress the at least one prong.

7. The bracket of claim 6 wherein the at least one prong comprises a pair of prongs extending downwardly from the lower end of the rails on the docking section of the adapter body and wherein the at least one shoulder comprises a pair of shoulders extending downwardly from the lower end of the channel on the docking body.

8. The bracket of claim 1 wherein the attachment section of the adapter comprises at least one bolt hole.

9. The bracket of claim 8 where the at least one bolt hole comprises a pair of vertically spaced apart bolt holes.

10. The bracket of claim 8 wherein each of the at least one bolt hole is a vertically oriented slot.

11. The bracket of claim 8 wherein the bracket further comprises at least one bolt and nut sized for the at least one bolt hole.

12. An assembly comprising the bracket of claim 1, a gun holder, and a connector for removably attaching the gun holder to the attachment section of the adapter body.

13. The assembly of claim 12 wherein the gun holder is selected from the group consisting of a flexible holster, a rigid holster, a gun enclosure, and a magnet.

14. The assembly of claim 13 wherein the gun holder is a magnet.

15. The assembly of claim 12 wherein the gun holder comprises a magnet and a magnetically transparent holster.

16. An assembly comprising the bracket of claim 1, a gun, a gun holder adapted to hold the gun, and a connector for removably attaching the gun holder to the attachment section of the adapter body.

17. A bracket assembly comprising a pair of brackets, each of the pair of brackets configured as defined in claim 1, each of the pair of brackets attachable to a different one of the hinges on a single door in vertical alignment for supporting a long gun.

18. The bracket of claim 1 wherein the gun holder is selected from the group consisting of a flexible holster, a rigid holster, a gun enclosure, a rack, and a magnet.

19. The bracket of claim 1 further comprising a bracket pin configured to be received in the pin bore of the door hinge.

20. A method for supporting a gun on a first door, wherein the first door comprises at least one door hinge including a first hinge, wherein each of the at least one door hinge comprises a plurality of knuckles, each knuckle having a pin passage, wherein when the knuckles are aligned, the pin passages therethrough collectively form a pin bore for receiving a hinge pin, each of the at least one door hinge further comprising a hinge pin, the method comprising:

providing at least one bracket, the at least one bracket comprising a first bracket, wherein each of the at least one bracket comprises:

a docking station comprising:

a docking body;

at least one hinge loop extending from the body, the loop sized to fit with the knuckles of the at least one door hinge so that the loop is alignable with the pin bore; and a docking recess on the docking body;

an adapter comprising:

an adapter body;

a docking section configured for manual tool-free engagement and disengagement with the docking recess of the docking station; and an attachment section;

a detent configured to releasably secure the docking section of the adapter in the docking recess of the docking station; and a bracket pin configured to be received in the pin bore of the at least one door hinge;

providing a first gun holder attachable to the adapter of the first bracket;

removing the hinge pin from the first hinge of the first door;

positioning the docking station of the first bracket so that the at least one hinge loop is aligned with the pin bore of the first hinge of the first door;

inserting the bracket pin of the first bracket in the pin bore of the first hinge of the first door;

attaching the first gun holder to the adapter section of the adapter of the first bracket;

engaging the docking section of the adapter of the first bracket in the docking recess of the docking station of the first bracket; and placing a gun in the first gun holder.

21. The method of claim 20, wherein the at least one door hinge of the first door further comprises a second hinge, wherein the at least one bracket further comprises a second bracket, and wherein the method further comprising:

providing a second gun holder attachable to the adapter of the second bracket;

removing the hinge pin from the second hinge of the first door;

positioning the docking station of the second bracket so that the at least one hinge loop is aligned with the pin bore of the second hinge of the first door;

inserting the bracket pin of the second bracket in the pin bore of the second hinge of the first door;

attaching the second gun holder to the adapter section of the adapter of the second bracket;

engaging the docking section of the adapter of the second bracket in the docking recess of the docking station of the second bracket;

vertically aligning the first and second brackets;

providing a long gun; and placing the long gun in the first gun holder in the first bracket and the second gun holder in the second bracket.

22. A method for supporting a gun in a gun holder alternately on a first door and a second door, wherein the first door comprises a first hinge and the second door comprises a second hinge, wherein each of the first and second hinges comprises a hinge pin and a plurality of knuckles, each knuckle having a pin passage, wherein when the plurality of knuckles are aligned, the pin passages therethrough collectively form a pin bore for receiving the hinge pin, the method comprising:

providing a bracket assembly comprising:

first and second docking stations, each comprising:

a docking body;

at least one hinge loop extending from the body, the hinge loop sized to fit with the plurality of knuckles of one of the first and second hinges so that the hinge loop is alignable with the pin bore of each of the first and second hinges; and a docking recess on the docking body;

an adapter comprising:

an adapter body;

a docking section configured for manual tool-free engagement and disengagement with the docking recess of each of the first and second docking stations; and an attachment section configured for attachment to the gun holder; and a detent configured to releasably secure the docking section of the adapter alternately in the docking recess of the first and second docking stations; and a first bracket pin configured to be received in the pin bore of the first hinge;

a second bracket pin configured to be received in the pin bore of the second hinge;

removing the hinge pin from each of the first and second hinges;

positioning the first docking station so that the at least one hinge loop is aligned with the pin bore of the first hinge;

inserting the first bracket pin through the pin bore of the first hinge and the at least one hinge loop aligned therewith;

positioning the second docking station so that the at least one hinge loop is aligned with the pin bore of the second hinge;

inserting the second bracket pin through the pin bore of the second hinge and the at least one hinge loop aligned therewith;

attaching the gun holder to the adapter;

engaging the docking section of the adapter in the docking recess of the first docking station;

disengaging the gun holder and the adapter from the first docking station while the gun is in the gun holder and the gun holder is attached to the adapter; and engaging the docking section of the adapter in the docking recess of the second docking station.

23. An assembly for installation on a door hinge, the door hinge comprising a plurality of knuckles, each knuckle having a pin passage, wherein when the knuckles are aligned, the pin passages therethrough collectively form a pin bore for receiving a hinge pin, the assembly comprising:

a bracket comprising:

a docking station comprising:

a docking body;

at least one hinge loop extending from the body, the loop sized to fit with the knuckles of the door hinge so that the loop is alignable with the pin bore; and a docking recess on the docking body;

an adapter comprising:

an adapter body;

a docking section removably engageable with the docking recess of the docking station;

an attachment section configured for attachment to the gun holder; and a gun holder attachable to the attachment section of the adapter.

24. The assembly of claim 23 wherein the gun holder is selected from the group consisting of a flexible holster, a rigid holster, a gun enclosure, and a magnet.

25. The assembly of claim 23 further comprising a gun supportable by the gun holder.

26. The bracket of claim 23 further comprising a detent configured to releasably secure the docking section of the adapter in the docking recess of the docking station.

27. A bracket assembly for installation on a door for supporting a long gun, wherein the door comprises first and second door hinges, wherein each of the first and second door hinges comprises a plurality of knuckles, each knuckle having a pin passage, wherein when the knuckles are aligned, the pin passages therethrough collectively form a pin bore for receiving a hinge pin, the assembly comprising:

first and second brackets, each comprising:

a docking station comprising:

a docking body;

at least one hinge loop extending from the body, the loop sized to fit with the knuckles of one of the first and second door hinges so that the loop is alignable with the pin bore; and a docking recess on the docking body;

an adapter comprising:

an adapter body;

a docking section engageable with the docking recess of the docking station; and an attachment section attachable to the gun holder; and each of the first and second brackets attachable to a different one of the first and second door hinges in vertical alignment; and first and second gun holders, each attachable to the attachment section of the adapter of one of the first and second brackets.

28. A method for supporting a gun on a door, wherein the door comprises at door hinge, wherein the door hinge comprises a plurality of knuckles, each knuckle having a pin passage, wherein when the knuckles are aligned, the pin passages therethrough collectively form a pin bore for receiving a hinge pin, the door hinge further comprising a hinge pin, the method comprising:

providing a bracket comprising:

a docking station comprising:

a docking body;

at least one hinge loop extending from the body, the loop sized to fit with the knuckles of the door hinge so that the loop is alignable with the pin bore; and a docking recess on the docking body;

an adapter comprising:

an adapter body;

a docking section engageable with the docking recess of the docking station;

an attachment section configured for attachment to the gun holder;

providing a first gun holder attachable to the adapter of the bracket;

removing the hinge pin from the door hinge of the door;

positioning the docking station of the bracket so that the at least one hinge loop is aligned with the pin bore of the door hinge inserting the bracket pin in the pin bore of the door hinge;

attaching the gun holder to the adapter section of the adapter;

engaging the docking section of the adapter with the docking recess of the docking station; and placing a gun in the gun holder.

* * * * *